US007729645B2

(12) United States Patent
Noguchi

(10) Patent No.: US 7,729,645 B2
(45) Date of Patent: Jun. 1, 2010

(54) DEVELOPER CARTRIDGE AND IMAGE FORMING DEVICE

(75) Inventor: Kotaro Noguchi, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 486 days.

(21) Appl. No.: 11/729,827

(22) Filed: Mar. 30, 2007

(65) Prior Publication Data

US 2008/0080903 A1 Apr. 3, 2008

(30) Foreign Application Priority Data

Sep. 28, 2006 (JP) ..... 2006-264347

(51) Int. Cl.
*G03G 15/08* (2006.01)

(52) U.S. Cl. ..... 399/262; 399/119; 399/120

(58) Field of Classification Search ..... 399/262, 399/120, 258, 119, 260, 227
See application file for complete search history.

(56) References Cited

U.S. PATENT DOCUMENTS

| | | | | |
|---|---|---|---|---|
| 6,259,877 | B1 | 7/2001 | Taniyama et al. | |
| 2005/0123322 | A1* | 6/2005 | Okamoto et al. | 399/258 |
| 2005/0135841 | A1* | 6/2005 | Murakami et al. | 399/262 |
| 2005/0175373 | A1* | 8/2005 | Okamoto et al. | 399/119 |
| 2005/0254860 | A1 | 11/2005 | Kimura et al. | |
| 2006/0104671 | A1 | 5/2006 | Murakami et al. | |
| 2006/0182469 | A1 | 8/2006 | Koyama et al. | |
| 2008/0085136 | A1 | 4/2008 | Kimura et al. | |

FOREIGN PATENT DOCUMENTS

| | | | |
|---|---|---|---|
| CN | 1195792 | A | 10/1998 |
| EP | 0 661 608 | A2 | 7/1995 |
| EP | 0 689 104 | A1 | 12/1995 |
| EP | 0 905 577 | A2 | 3/1999 |
| EP | 1 041 453 | A2 | 10/2000 |
| EP | 1 542 091 | A1 | 6/2005 |
| JP | A-08-185030 | | 7/1996 |
| JP | A-08-248754 | | 9/1996 |
| JP | A-09-114214 | | 5/1997 |
| JP | A 2001-083792 | | 3/2001 |
| JP | A-2004-264429 | | 9/2004 |
| JP | A-2005-221831 | | 8/2005 |
| JP | A-2005-221866 | | 8/2005 |
| JP | A-2005-321472 | | 11/2005 |
| JP | A-2005-326772 | | 11/2005 |
| JP | A-2006-163374 | | 6/2006 |

* cited by examiner

*Primary Examiner*—David P Porta
*Assistant Examiner*—Milton Gonzalez
(74) *Attorney, Agent, or Firm*—Oliff & Berridge, PLC

(57) ABSTRACT

A developer cartridge detachably mounted to a device main body includes a tubular cartridge main body that houses a developer and an extending portion that communicates with the cartridge main body, which extends from an end portion in a longitudinal direction of the cartridge main body. An outside shape of a section of the extending portion, along a direction that is orthogonal to the longitudinal direction, is smaller than that of the cartridge main body. A cartridge-side opening portion is provided at a side wall of the extending portion, and a cartridge-side shutter is provided at an outside of the side wall of the extending portion, which moves in a direction intersecting the longitudinal direction along the side wall to thereby open and close the cartridge-side opening portion.

12 Claims, 8 Drawing Sheets

DEVELOPER CARTRIDGE AND IMAGE FORMING DEVICE

CROSS-REFERENCE TO RELATED APPLICATION

This application is based on and claims priority under 35 USC 119 from Japanese Patent Application No. 2006-264347 filed on Sep. 28, 2006.

BACKGROUND

1. Technical Field

The present invention relates to a developer cartridge and an image forming device.

2. Related Art

In an image forming device, a developer is supplied from a developer cartridge to a developing unit. When the developer in the developer cartridge runs out, the developer cartridge is detached from the image forming device and is replaced by a new developer cartridge.

SUMMARY

According to a first aspect of the invention, there is provided a developer cartridge detachably mounted to a device main body, the cartridge including: a tubular cartridge main body that houses a developer; an extending portion that communicates with the cartridge main body and extends from an end portion in a longitudinal direction of the cartridge main body, in which an outside shape of a section of the extending portion, along a direction that is orthogonal to the longitudinal direction, is smaller than that of the cartridge main body; a cartridge-side opening portion that is provided at a side wall of the extending portion; and a cartridge-side shutter that is provided at an outside of the side wall of the extending portion and moves in a direction intersecting the longitudinal direction along the side wall to thereby open and close the cartridge-side opening portion.

BRIEF DESCRIPTION OF THE DRAWINGS

Exemplary embodiments of the present invention will be described in detail based on the following figures, wherein:

FIGS. 3A and 3B show an extending portion of the developer cartridge, in which FIG. 3A is a figure showing a closed state of a shutter and FIG. 3B is a figure showing an open state of the shutter;

FIGS. 6A, 6B, and 6C are enlarged sectional views showing the manner of mounting of the developer cartridge to the mounting portion in that order, in which

DETAILED DESCRIPTION

Figure 1:
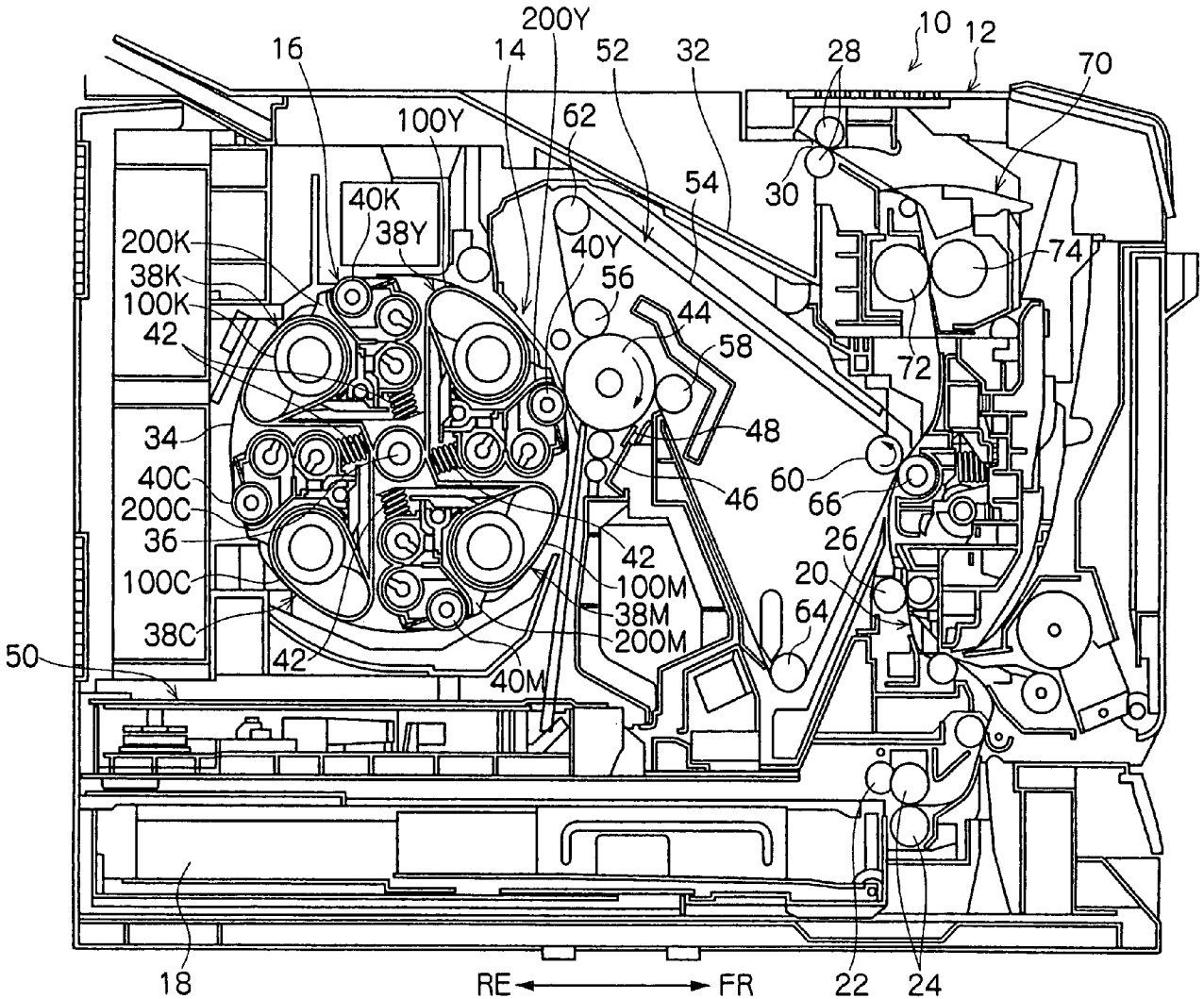
FIG. 1 is a schematic side view showing a structure of an image forming device of an exemplary embodiment of the invention.

The best exemplary embodiment of the present invention will be described below in detail on the basis of the exemplary embodiment shown in the drawings. An arrow FR designates a front side and an arrow RE designates a rear side.

As shown in FIG. 1, an image forming device 10 has a device main body 12 and an image forming portion 14 having a rotary developing device 16 and the like is disposed at a substantially central portion of the device main body 12.

A paper feed cassette 18 in which sheets of recording paper are housed is disposed at a lower portion of the device main body 12 and a feed roller 22 for feeding the sheets of recording paper from the paper feed cassette 18 and retard rollers 24 for separating the fed sheets of recording paper one by one are disposed at an upper portion of the front side (designated by the arrow FR) of the paper feed cassette 18.

A conveying path 20 is a passage for the sheets of recording paper from the feed roller 22 to an ejection port 30. The conveying path 20 is on the front side of the image forming device 10 and is formed in a substantially vertical direction from the paper feed cassette 18 to a fixing device 70 which will be described later. On this conveying path 20, a secondary transfer roller 66 and a secondary transfer backup roller 60, which will be described later are disposed upstream from the fixing device 70, and a resist roller 26 is disposed upstream from the secondary transfer roller 66 and the secondary transfer backup roller 60. On the conveying path 20, ejection rollers 28 are also disposed in a vicinity of the ejection port 30.

Therefore, the sheets of recording paper fed out by the feed roller 22 from the paper feed cassette 18 are separated by the retard rollers 24 and only the uppermost sheet of recording paper is led to the conveying path 20. Then, the sheet of recording paper is temporarily stopped by the resist roller 26 to adjust timing and is fed to a secondary transfer portion (which will be described later) between the secondary transfer roller 66 and the secondary transfer backup roller 60.

On a slightly rear side of a substantially central portion of the device main body 12, the rotary developing device 16 is disposed. The rotary developing device 16 includes developing units 38Y, 38M, 38C, and 38K for forming toner images of four colors, i.e., yellow (Y), magenta (M), cyan (C), and black (K), respectively, in a rotating body 34 and rotates to the left (counterclockwise in FIG. 1) about a rotary shaft 36. The developing units 38Y, 38M, 38C, and 38K have developing rollers 40Y, 40M, 40C, and 40K, respectively, and are pressed substantially in radial directions of the rotating body 34 by elastic bodies 42 such as coil springs, for example.

An image carrier 44 formed of a photoreceptor drum, for example, is disposed to be in contact with the rotary developing device 16. A part of an outer periphery of each of the developing rollers 40Y, 40M, 40C, and 40K protrudes 2 mm, for example, in a radial direction from an outer periphery of the rotating body 34 when the image roller is not in contact with the image carrier 44. Tracking rollers (not shown) having slightly larger diameters than a diameter of each of the developing rollers 40Y, 40M, 40C, and 40K are provided to opposite ends of each of the developing rollers 40Y, 40M, 40C, and 40K to rotate coaxially with each of the developing rollers 40Y, 40M, 40C, and 40K.

In other words, the developing rollers 40Y, 40M, 40C, and 40K of the developing units 38Y, 38M, 38C, and 38K are disposed at the outer periphery of the rotating body 34 at intervals of 90° around the rotary shaft 36. While the tracking rollers of each of the developing rollers 40Y, 40M, 40C, and 40K come in contact with flanges (not shown) provided to opposite ends of the image carrier 44 to form a predetermined clearance between each of the developing rollers 40Y, 40M, 40C, and 40K and the image carrier 44, each of the developing rollers 40Y, 40M, 40C, and 40K develops a latent image on the image carrier 44 with each color.

A charging roller 46 as a charging member for uniformly charging a surface of the image carrier 44 is provided under the image carrier 44. A cleaning blade 48 as a cleaning member is in contact with the image carrier 44 downstream from the charging roller 46 in a rotating direction of the image carrier 44. With this cleaning blade 48, waste toner that remains on the image carrier 44 after primary transfer is scraped off by the cleaning blade 48.

An exposure device 50 for writing the latent image on the image carrier 44 charged by the charging roller 46 by using a light beam such as a laser beam is disposed below the rotary developing device 16. On the front side of the rotary developing device 16, an intermediate transfer device 52 for conveying the toner images made visible by the rotary developing device 16 from the image carrier 44 as a primary transfer portion to the secondary transfer roller 66 as the secondary transfer portion is provided.

The intermediate transfer device 52 is formed of an intermediate transfer belt 54 as an intermediate transfer body, a wrap-in roller 56, a wrap-out roller 58, a secondary transfer backup roller 60, and tension rollers 62, 64 and the intermediate transfer belt 54 stretched out forward by the secondary transfer backup roller 60 is in contact with the secondary transfer roller 66.

The intermediate transfer belt 54 includes the primary transfer portion (image carrier wrapping area) that is in contact with the image carrier 44 in a wrapping manner between the wrap-in roller 56 and the wrap-out roller 58 and is wound on a predetermined area of the image carrier 44 to follow rotation of the image carrier 44. After the toner image on the image carrier 44 is primarily transferred to the intermediate transfer belt 54, the intermediate transfer belt 54 conveys the toner image transferred primarily toward the secondary transfer backup roller 60.

The secondary transfer roller 66 faces the secondary transfer backup roller 60 of the intermediate transfer device 52 with the conveying path 20 positioned between them. In other words, an area between the secondary transfer roller 66 and the secondary transfer backup roller 60 functions as the secondary transfer portion and the secondary transfer roller 66 secondarily transfers the toner images that have been transferred primarily onto the intermediate transfer belt 54 to the sheet of recording paper with assistance by the secondary transfer backup roller 60. Although it is not shown in the drawings, a cleaning member for scarping off waste toner that remains on the intermediate transfer belt 54 after the secondary transfer is disposed in a vicinity of the tension roller 62.

Above (on the downstream side of) the secondary transfer portion, the fixing device 70 is disposed. The fixing device 70 includes a heat roller 72 and a pressure roller 74 and the heat roller 72 and the pressure roller 74 heat, pressurize, and melt the toner image that has been transferred secondarily to the sheet of recording paper by the secondary transfer roller 66 and the secondary transfer backup roller 60 to thereby fix the toner image on the sheet of recording paper.

When the toner image that has been transferred to the sheet of recording paper is fixed by the fixing device 70, the sheet of recording paper is ejected from the ejection port 30 to an ejection portion 32. The ejection portion 32 is low at the ejection port 30 side and gradually slopes up backward (rearward).

Next, an image forming process will be described.

If an image forming signal is sent to the image forming device 10, the image carrier 44 is uniformly charged by the charging roller 46. Then, the uniformly charged image carrier 44 is irradiated with the light beam from the exposure device 50 based on the image signal. In other words, the light beam from the exposure device 50 exposes a surface of the image carrier 44 to thereby form the latent image.

The latent image formed on the surface of the image carrier 44 by the exposure device 50 is developed by the rotary developing device 16 as toner images of the respective colors, i.e., yellow (Y), magenta (M), cyan (C), and black (K) and is overlaid and transferred primarily onto the intermediate transfer belt 54. In this way, a full-color toner image is formed on the intermediate transfer belt 54. Incidentally, the waste toner that remains on the image carrier 44 after the primary transfer is scraped off by the cleaning blade 48 and collected.

On the other hand, the sheet of recording paper housed in the paper feed cassette 18 is fed out by the feed roller 22 according to a paper feed signal or the like, separated and led to the conveying path 20 by the retard rollers 24, stopped temporarily by the resist roller 26 to adjust timing, and conveyed to the secondary transfer portion.

When the sheet of recording paper is led to the secondary transfer portion, the full-color toner image on the intermediate transfer belt 54 is transferred secondarily onto the sheet of recording paper by the secondary transfer roller 66 and the secondary transfer backup roller 60. After the secondary transfer, the waste toner that remains on the intermediate transfer belt 54 is scraped off by the cleaning member (not shown) and collected.

The sheet of recording paper onto which the full-color toner image has been transferred in this manner is led to the fixing device 70 where the full-color toner image is fixed on the sheet of recording paper by heat and pressure by the heat roller 72 and the pressure roller 74. Then, the sheet of recording paper on which the full-color toner image has been fixed is ejected by the ejection roller 28 from the ejection port 30 to the ejection portion 32.

The developing units 38Y, 38M, 38C, and 38K of the rotary developing device 16 have developer cartridges 100Y, 100M, 100C, and 100K for housing corresponding developers of yellow (Y), magenta (M), cyan (C), and black (K), respectively. The developer cartridges 100Y, 100M, 100C, and 100K are detachably mounted to mounting portions 200Y, 200M, 200C, and 200K of the developing units 38Y, 38M, 38C, and 38K, respectively, and supply new developers. When the developer in the developer cartridge 100Y, 100M, 100C, or 100K runs out, the developer cartridge 100Y, 100M, 100C, or 100K is detached from the device main body 12 and is replaced by a new developer cartridge 100Y, 100M, 100C, or 100K.

In the exemplary embodiment, two-component developers including toner and carrier are used as the developers. A trickle developing system is employed.

The trickle developing system is a developing system for carrying out development while gradually supplying developer and discharging (collecting) surplus deteriorated developer (including much deteriorated carrier) so as to prevent degradation in electrification (charging) performance for the developer and to prolong an interval between developer replacements.

Next, the developer cartridges 100Y, 100M, 100C, and 100K will be described. Because each of the developer cartridges 100Y, 100M, 100C, and 100K has the same structure, the letters Y, M, C, and K will be omitted in the following description.

Figure 2:
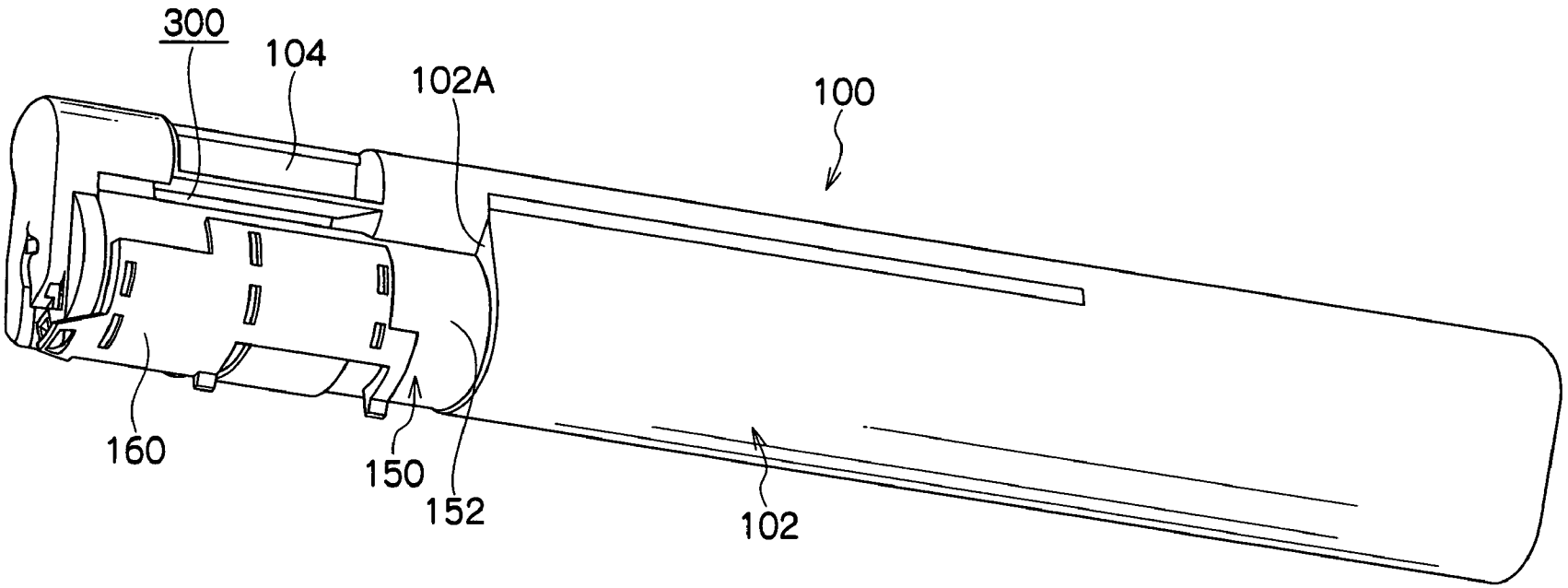
FIG. 2 is a perspective view showing a developer cartridge of the exemplary embodiment of the invention.

As shown in FIG. 2, the whole developer cartridge 100 is in a long cylindrical shape that is long in an axial direction of the rotary shaft 36 (see FIG. 1) of the rotary developing device 16.

The developer cartridge 100 has a cartridge main body 102 for housing the developer. The cartridge main body 102 has a section orthogonal to a longitudinal direction and having an oval-like outside shape. From longitudinal one end portion 102A of the cartridge main body 102, a cylindrical extending portion 150 extends in the longitudinal direction. An outside shape of a section of the cylindrical extending portion 150 orthogonal to the longitudinal direction is smaller than that of the cartridge main body 102 and is substantially circular. The cartridge main body 102 and the extending portion 150 communicate with each other.

The cartridge main body 102 has a grip portion 104 that curves and connects to an end portion of the extending portion 150 after protruding in the longitudinal direction from the end portion 102A. Between the grip portion 104 and the extending portion 150, a clearance 300 is formed.

Figure 3A:
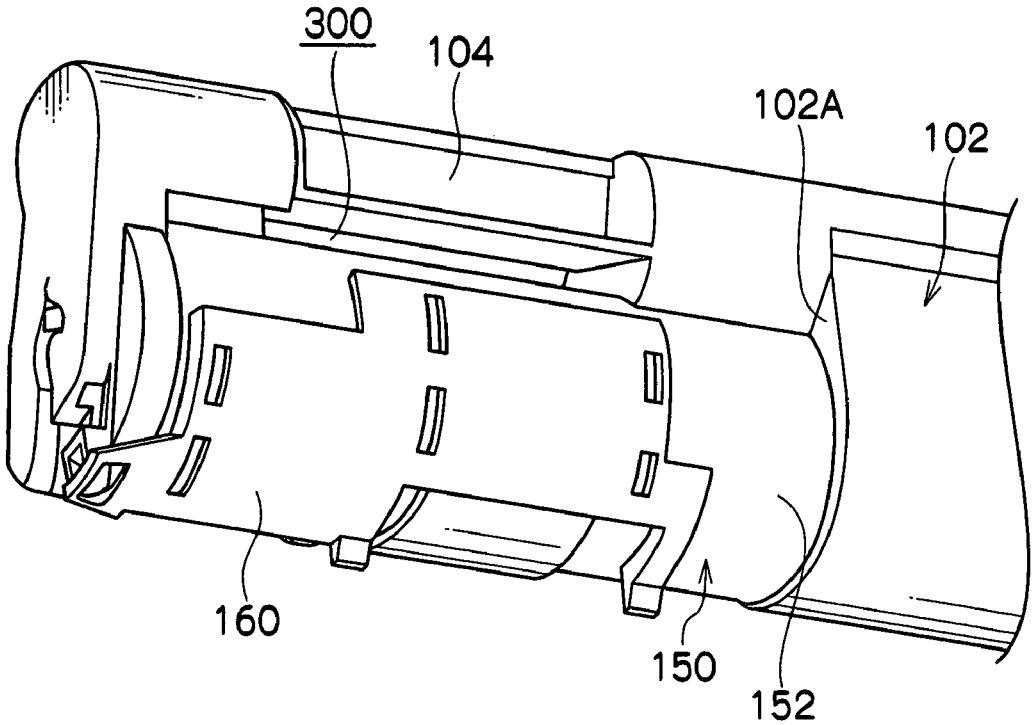
Figure 3B:
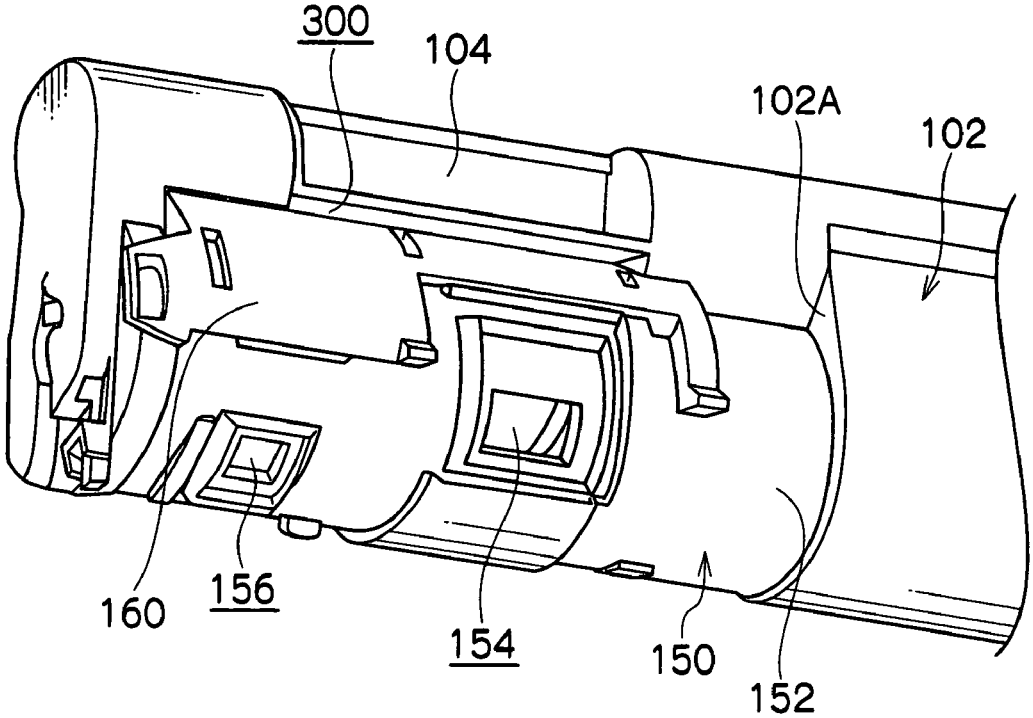

As shown in FIG. 3B, a side wall (peripheral wall) 152 of the extending portion 150 is formed with a supply port 154 for supplying the developer in the developer cartridge 100 to the developing unit 38 and a collecting port 156 for collecting the developer discharged from the developing unit 38 into the developer cartridge 100.

On an outside of the side wall 152 of the extending portion 150, a shutter 160 in a shape of an arc-shaped plate formed along a curve of the side wall 152 is provided. The shutter 160 moves (slides) in a circumferential direction (direction orthogonal to the longitudinal direction) along the side wall 152 and opens and closes the supply port 154 and the collecting port 156 as shown in FIGS. 3A and 3B.

Figure 7:
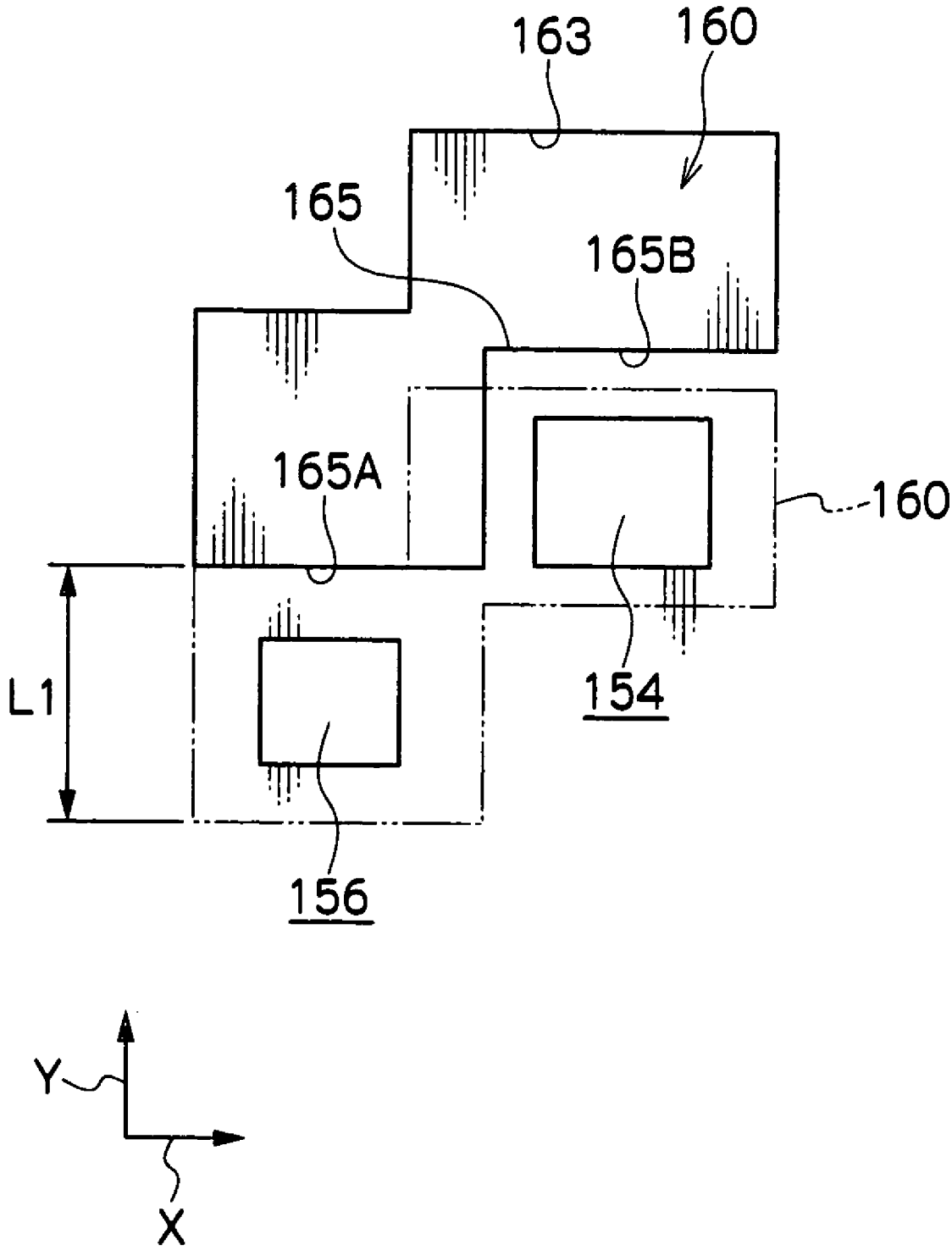
FIG. 7 is a figure schematically showing a supply port, a collecting port, and a shutter of a developer cartridge of the exemplary embodiment of the invention.

As schematically shown in FIG. 7, the supply port 154 and the collecting port 156 are disposed while displaced from each other in the longitudinal direction (direction X) and the moving direction (direction Y) of the shutter 160. In the present exemplary embodiment, in FIG. 7, the right supply port 154 is positioned on an upper side and the left collecting port 156 is positioned on a lower side.

Moreover, a closing-side end portion 165 of the shutter 160 for closing the supply port 154 and the collecting port 156 is in a stepped shape corresponding to circumferential positions of the supply port 154 and the collecting port 156. In other words, in the exemplary embodiment, a left half (on the collecting port 156 side) 165A is one step below a right half (on the supply port 154 side) 165B in FIG. 7. An end portion 163 on the opposite side to the closing-side end portion 165 is similarly formed in a stepped shape.

As shown in FIG. 3B, a path of movement of the shutter 160 is provided in the clearance 300 between the grip portion 104 and the extending portion 150. In other words, if the shutter 160 is moved to open the supply port 154 and the collecting port 156, the shutter 160 enters the clearance 300 (see also FIG. 5C).

Figure 5A:
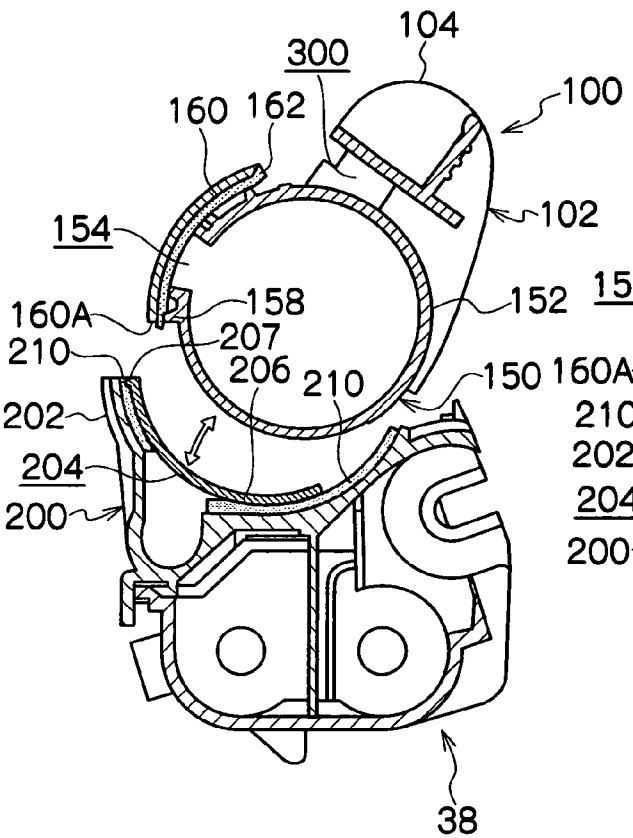
FIGS. 5A, 5B, and 5C are sectional views showing a manner of mounting of the developer cartridge to the mounting portion in that order.

Moreover, as shown in FIG. 5A, on a back face of the shutter 160 on a side of the extending portion 150, a seal member 162 formed of an elastic member such as sponge and for sealing peripheries of the supply port 154 and the collecting port 156 when the shutter 160 is closed is stuck. Furthermore, in order to enhance sealing performance, a protruding portion 158 for pressing an end portion of the seal member 162 is provided to the side wall 152 of the extending portion 150 (see also FIGS. 6A and 6B).

Next, the mounting portions 200Y, 200M, 200C, and 200K to which the developer cartridges 100Y, 100M, 100C, and 100K are detachably mounted will be described. Because each of the mounting portions 200Y, 200M, 200C, and 200K has the same structure, letters Y, M, C, and K will be omitted in the following description.

Figure 4:
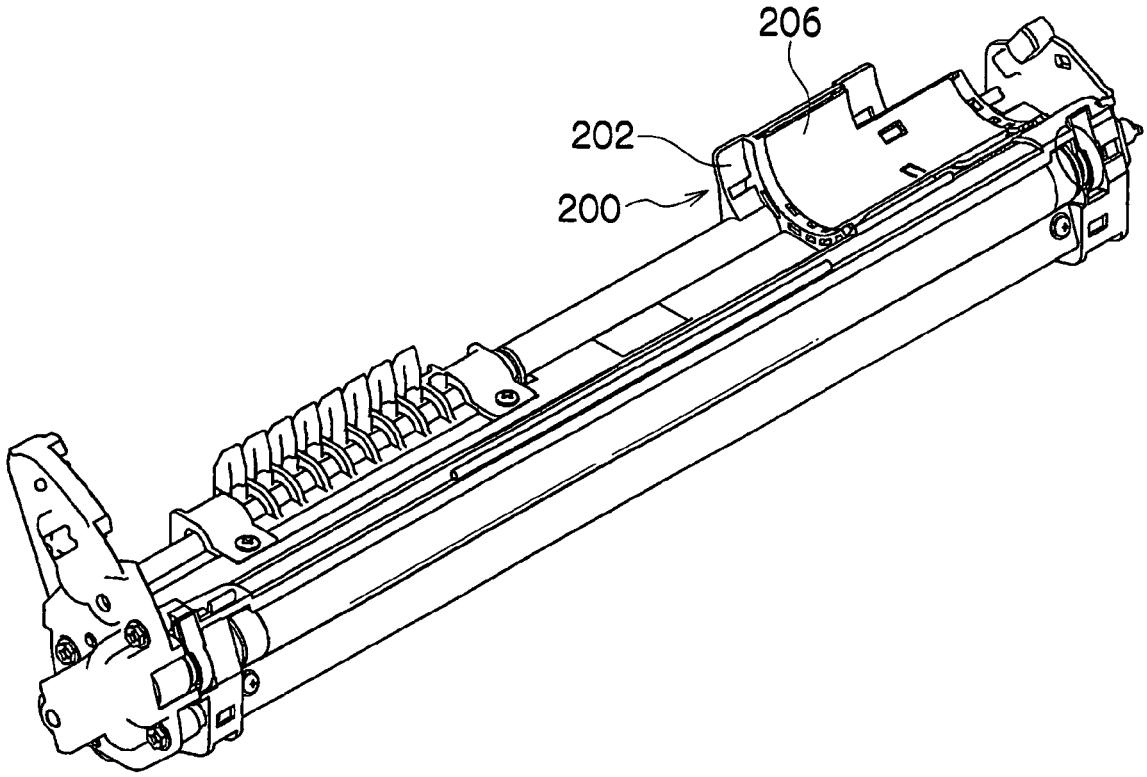
FIG. 4 is a figure showing a mounting portion of a developing unit.
Figure 5B:
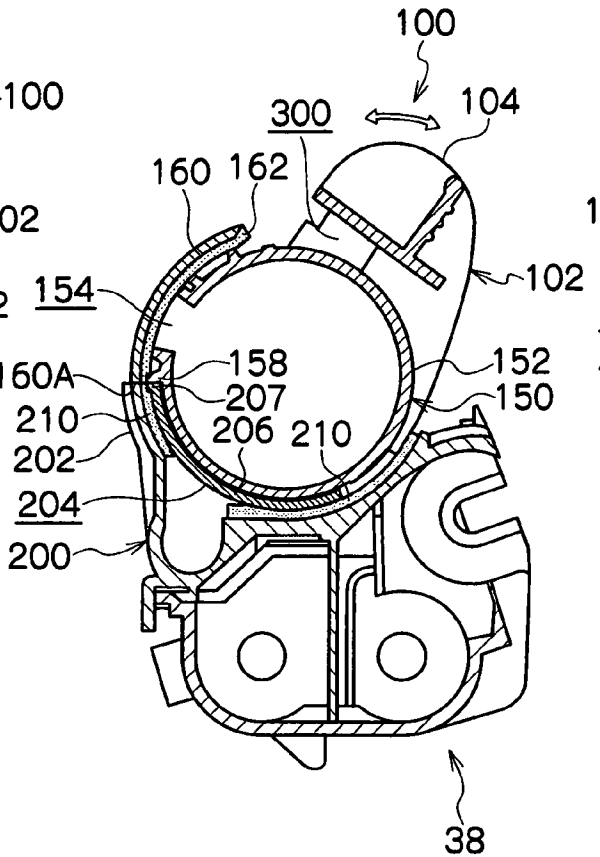
Figure 5C:
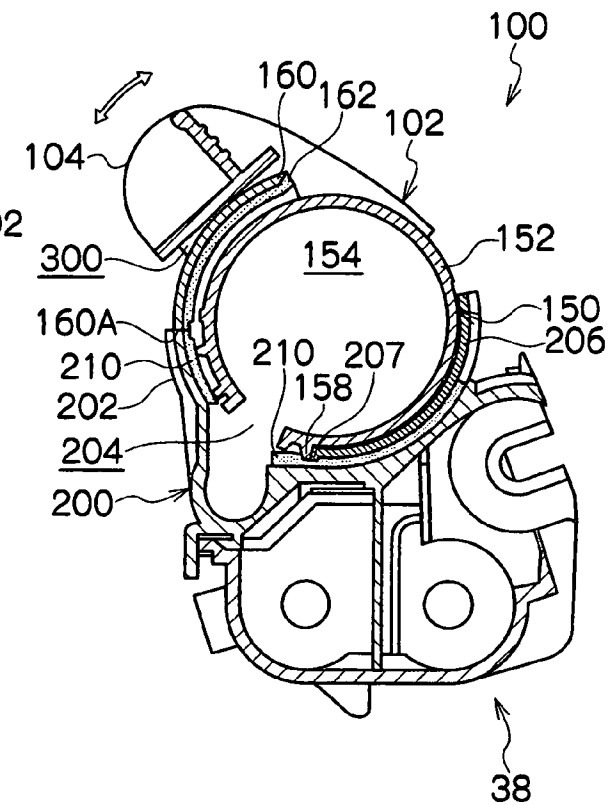

As shown in FIG. 4, the mounting portion 200 is formed with a receiving portion 202 curved in a substantially arc shape along the curve of the side wall 152 of the extending portion 150 of the developer cartridge 100. As shown in FIGS. 5A to 5C, the receiving portion 202 is formed with a supply port 204 and a collecting port (not shown) facing the above-described supply port 154 and collecting port 156 (see FIG. 2) of the developer cartridge 100. Moreover, a shutter 206 for opening and closing the supply port 204 and the collecting port is provided to the receiving portion 202 to be movable along a circumferential direction.

Around the supply port 204 and the collecting port, a seal member 210 formed of an elastic member such as sponge is stuck. In order to enhance sealing performance, a protruding portion 207 for pressing an end portion of the seal member 210 is provided to the shutter 206 (see also FIGS. 6A to 6D).

Next, mounting of the developer cartridge 100 to the mounting portion 200 will be described by using FIGS. 5A to 6D. The collecting port 156 of the developer cartridge 100 and the collecting port of the mounting portion 200 are not shown in FIGS. 5A to 6D but operate similarly to the supply port 154 of the developer cartridge 100 and the supply port 204 of the mounting portion 200.

As shown in FIGS. 5A and 5B, the extending portion 150 of the developer cartridge 100 is placed on the receiving portion 202 of the mounting portion 200. An end portion 160A of the shutter 160 of the developer cartridge 100 comes in contact with an end portion of the receiving portion 202 (see also FIGS. 6A and 6B). At this time, the supply port 154 and the collecting port 156 of the developer cartridge 100 and the supply port 204 and the collecting port (not shown) of the mounting portion 200 are not facing each other and are closed with the shutter 160 of the cartridge and the shutter 206 of the mounting portion, respectively.

Figure 6A:
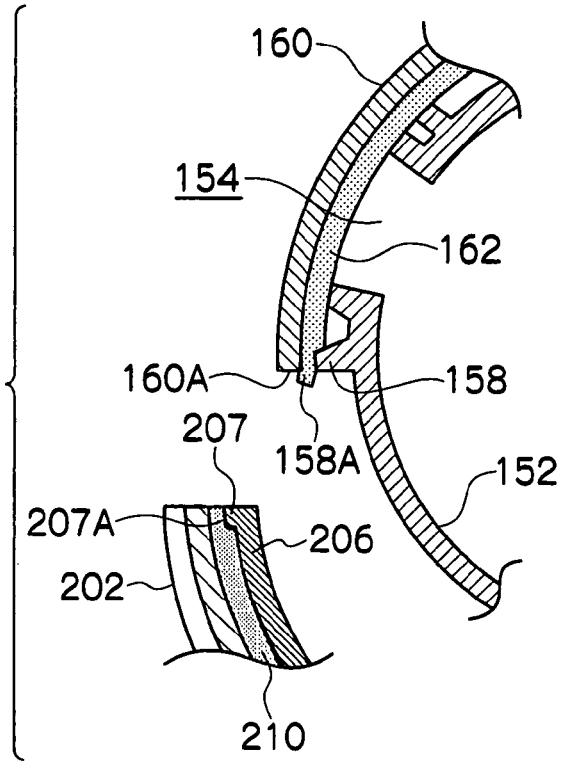
Figure 6B:
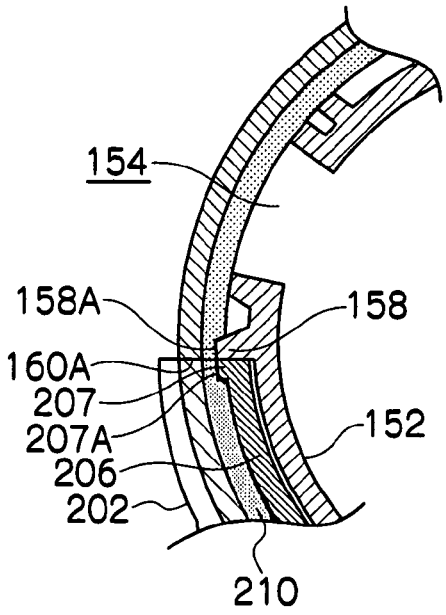

As shown in FIGS. 6A and 6B, the protruding portion 158 of the side wall 152 of the extending portion 150 and the protruding portion 207 of the shutter 206 of the mounting portion 200 come in contact with each other. As shown in FIG. 6D, there is no step between a tip end portion 158A and a tip end portion 207A of the protruding portion 158 and the protruding portion 207 in a circumferential direction and they become contiguous with each other. In other words, the protruding portion 158 and the protruding portion 207 become integral with each other and are like one protruding portion. The wording, "there is no step between the tip end portion 158A and the tip end portion 207A and they are contiguous with each other" allow a step that is formed due to molding errors and assembly errors of parts.

Next, as shown in FIGS. 5B and 5C, the grip portion 104 is turned to rotate the developer cartridge 100. At this time, the end portion 160A of the shutter 160 of the developer cartridge 100 is in contact with the end portion of the receiving portion 202 and therefore the shutter 160 does not move (see FIGS. 5B and 6B). In other words, by movements of the supply port 154 and the collecting port 156 of the extending portion 150, the shutter 160 opens. Furthermore, the shutter 206 of the mounting portion 200 opens in conjunction with rotation of the developer cartridge 100.

Figure 6C:
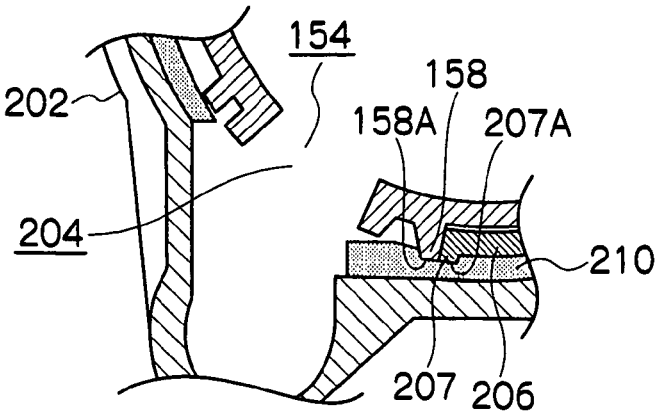
Figure 6D:
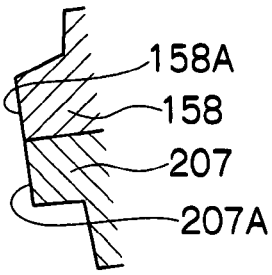
FIG. 6D is an enlarged view of a cartridge-side protruding portion and a mounting portion-side protruding portion.

Then, as shown in FIGS. 5C and 6C, the supply port 154 and the collecting port 156 of the developer cartridge 100 and the supply port 204 and the collecting port (not shown) of the mounting portion 200 face each other.

To detach the developer cartridge 100, the above procedure is reversed.

Next, operation of the exemplary embodiment will be described.

As shown in FIGS. 2 to 5C, an outside shape of a section orthogonal to the longitudinal direction of the developer cartridge 100 is smaller at its extending portion 150 than at its cartridge main body 102. Moreover, the grip portion 104 protruding in the longitudinal direction from the end portion 102A of the cartridge main body 102 to form the clearance 300 between the extending portion 150 and the grip portion 104 is provided. The cartridge-side shutter 160 provided on the outside of the side wall 152 of the extending portion 150 moves in the direction orthogonal to the longitudinal direction along the side wall 152 of the extending portion 150 to open and close the supply port 154 and the collecting port 156. At this time, the path of movement of the shutter 160 is secured by passing through the clearance 300.

In other words, because the path of the shutter 160 is provided at a space formed by difference (clearance 300 in the exemplary embodiment) between the outside shape of the cartridge main body 102 and the outside shape of the extending portion 150, it is easy to secure the path of the shutter 160 without reducing opening areas of the supply port 154 and the collecting port 156 and restricting the arrangement of them (there is no problem if the supply port 154 and the collecting port 156 are disposed in separate positions as in the exemplary embodiment) even if the developer cartridge 100 is miniaturized. Moreover, the space formed by difference between the outside shape of the cartridge main body 102 and the outside shape of the extending portion 150 is used effectively by providing the grip portion 104 that is gripped to rotate the developer cartridge 100. It is also possible to further effectively use the portion by housing the developer in the grip portion 104.

Although the outside shape of the section orthogonal to the longitudinal direction of the cartridge main body 102 is not circular (oval-shaped in the exemplary embodiment) for miniaturization and design, the path of the shutter 160 is not affected by the shape of the cartridge main body 102. Therefore, a degree of freedom in design of the cartridge main body 102 is high. Moreover, because the extending portion 150 is substantially circular, it is easy to form the path of the shutter 160 along the side wall 152 of the extending portion 150.

Figure 8:
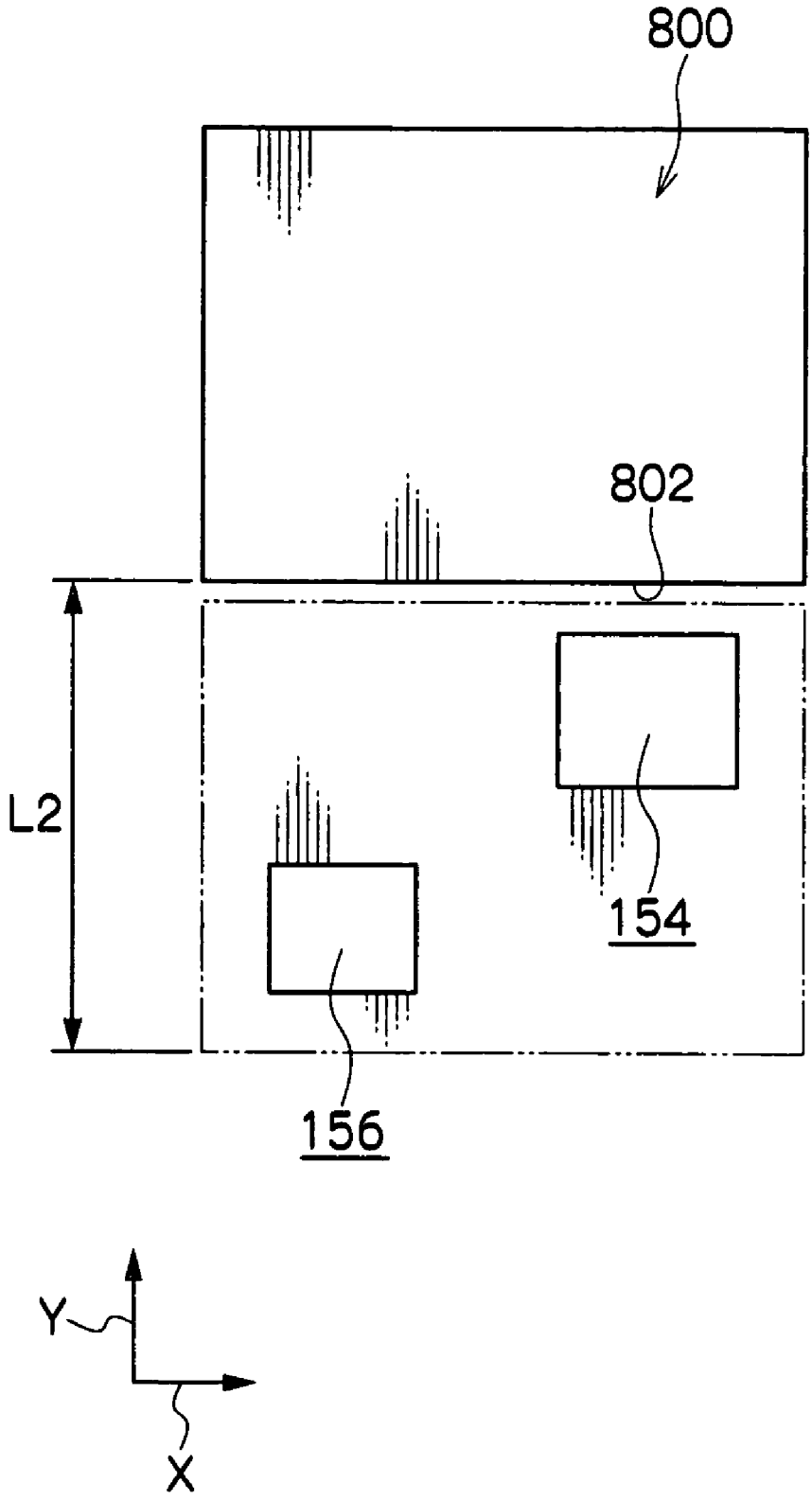
FIG. 8 is a figure showing a case in which a rectangular shutter is applied to FIG. 7.

Furthermore, as shown in FIG. 7, the supply port 154 and the collecting port 156 are disposed while being displaced from each other in the longitudinal direction (direction X) and the moving direction (direction Y) of the shutter 160. The closing-side end portion 165 of the shutter 160 is in the stepped shape (including the end portion 165A and the end portion 165B) corresponding to the circumferential positions of the supply port 154 and the collecting port 156. Therefore, as can be understood by comparing the shutter 160 with a rectangular shutter 800 having a straight end portion 802 in FIG. 8, a distance of movement of the shutter 160 is shorter (compare L1 in FIG. 7 and L2 in FIG. 8). Therefore, it is easy to secure the path of the shutter 160.

Moreover, as shown in FIG. 6, the tip end portion 158A of the protruding portion 158 of the cartridge and the tip end portion 207A of the protruding portion 207 of the mounting portion are in contact with each other to be contiguous without forming a step and the protruding portion 158 and the protruding portion 207 move integrally. As a result, the protruding portions 158 and 207 cause little damage to the seal member 210 of the mounting portion (if there is the step, both the protruding portion 158 and protruding portion 207 cause damage to the seal member 210, respectively).

The term "cylindrical shape" in the present specification may further include shapes of the section along the direction orthogonal to the longitudinal direction other than a circle.

The invention is not restricted to the above exemplary embodiment.

For example, although the two-component developers including toner and carrier are used as developers in the above exemplary embodiment, the developers are not restricted thereto. It is essential only that the developers include toner, and it is also possible to use one-component developers including toner only. The trickle developing system is not necessarily employed.

Although the opening portion of the developer cartridge 100 is formed of two opening portions, i.e., the supply port 154 and the collecting port 156 in the above exemplary embodiment, it is not restricted to them. The opening portion may be formed of one opening or may be three or more openings.

Although a so-called "four-cycle system" in which a color image is formed by using only one photoreceptor is employed in the above exemplary embodiment, it is also possible to employ a so-called "tandem system" in which a color image is formed by using a plurality of photoreceptors or the image forming device may be for monochrome images.

Although the shutter 160 moves (slides) in the circumferential direction (direction orthogonal to the longitudinal direction) along the side wall 152 as shown in FIGS. 3A and 3B in the above exemplary embodiment, the direction is not restricted to it. It is also possible that the shutter 160 moves (slides) diagonally with respect to the circumferential direction (moves in a direction intersecting the longitudinal direction).

Although the extending portion 150 of the developer cartridge 100 has the substantially circular outside shape of the section orthogonal to the longitudinal direction in the above exemplary embodiment, the shape is not restricted to it. The outside shape may be a non-circular shape. A portion facing the path of the shutter 160 is preferably in an arc shape.

Although the cartridge main body 102 of the developer cartridge 100 has an oval-like outside shape of the section orthogonal to the longitudinal direction in the above exemplary embodiment, the shape is not restricted to it. A face facing the mounting portion 200 is preferably in an arc shape.

What is claimed is:

1. A developer cartridge detachably mounted to a device main body, the cartridge comprising:

a tubular cartridge main body that houses a developer;

an extending portion that communicates with the cartridge main body and extends from an end portion in a longitudinal direction of the cartridge main body, in which an outside shape of a section of the extending portion, along a direction that is orthogonal to the longitudinal direction, is smaller than that of the cartridge main body;

a cartridge-side opening portion that is provided at a side wall of the extending portion; and a cartridge-side shutter that is provided at an outside of the side wall of the extending portion and moves in a direction intersecting the longitudinal direction along the side wall to thereby open and close the cartridge-side opening portion, wherein the cartridge main body has a protruding portion that protrudes in the longitudinal direction from the end portion to form a clearance between the extending portion and the protruding portion, and a path of movement of the cartridge-side shutter extends through the clearance.

2. The developer cartridge of claim 1, wherein the protruding portion has a longitudinal end portion connected to the extending portion and is formed in a shape of a grip.

3. The developer cartridge of claim 1, wherein an outside shape of a section of the cartridge main body, along a direction that is orthogonal to the longitudinal direction, is non-circular.

4. The developer cartridge of claim 1, wherein the cartridge-side opening portion includes a plurality of openings.

5. The developer cartridge of claim 4, wherein at least two of the plurality of openings are disposed in positions displaced from each other in a moving direction of the cartridge-side shutter and the longitudinal direction, and an end portion of the cartridge-side shutter on a cartridge-side opening portion side thereof has a stepped shape corresponding to the positions of the plurality of openings.

6. An image forming device comprising:

a developer cartridge including a tubular cartridge main body that houses a developer, an extending portion that communicates with the cartridge main body and extends from an end portion in a longitudinal direction of the cartridge main body, in which an outside shape of a section of the extending portion, along a direction that is orthogonal to the longitudinal direction, is smaller than that of the cartridge main body, a cartridge-side opening portion that is provided at a side wall of the extending portion, and a cartridge-side shutter that is provided at an outside of the side wall of the extending portion and moves in a direction intersecting the longitudinal direction along the side wall to thereby open and close the cartridge-side opening portion; and a mounting portion that the developer cartridge is detachably mounted to and that has a device-side opening portion facing the cartridge-side opening portion, wherein the cartridge main body has a protruding portion that protrudes in the longitudinal direction from the end portion to form a clearance between the extending portion and the protruding portion, and a path of movement of the cartridge-side shutter extends through the clearance.

7. The image forming device of claim 6, wherein the mounting portion has a device-side shutter for opening and closing the device-side opening portion, the developer cartridge is mounted to the mounting portion and the cartridge-side opening portion moves as the extending portion of the developer cartridge rotates to thereby open the cartridge-side shutter, the device-side shutter opens in conjunction with the rotation, and the cartridge-side opening portion and the device-side opening portion face each other.

8. The image forming device of claim 7, wherein the extending portion of the developer cartridge has a cartridge-side protruding portion that presses a cartridge-side opening portion seal member provided at the cartridge-side shutter, the device-side shutter has a device-side protruding portion that presses a device-side opening portion seal member provided around the device-side opening portion, a tip end portion of the cartridge-side protruding portion and a tip end portion of the device-side protruding portion come in contact with each other without forming a step in a rotating direction when the developer cartridge is mounted to the mounting portion, and the cartridge-side protruding portion and the device-side protruding portion move integrally as the extending portion of the developer cartridge rotates.

9. The image forming device of claim 6, wherein the protruding portion has a longitudinal end portion connected to the extending portion and is formed in a shape of a grip.

10. The image forming device of claim 6, wherein an outside shape of a section of the cartridge main body, along a direction that is orthogonal to the longitudinal direction, is non-circular.

11. The image forming device of claim 6, wherein the cartridge-side opening portion includes a plurality of openings.

12. The image forming device of claim 11, wherein at least two of the plurality of openings are disposed in positions displaced from each other in a moving direction of the cartridge-side shutter and the longitudinal direction, and an end portion of the cartridge-side shutter on a cartridge-side opening portion side thereof has a stepped shape corresponding to the positions of the plurality of openings.

* * * * *